US005713341A

United States Patent [19]

Leisenring et al.

[11] Patent Number: 5,713,341

[45] Date of Patent: Feb. 3, 1998

[54] LEAN AIR/FUEL ENGINE FEEDBACK CONTROL SYSTEM

[75] Inventors: William Earl Leisenring, Gladstone; Dennis Craig Reed, Plymouth; Douglas Ray Hamburg, Bloomfield Hills, all of Mich.

[73] Assignee: Ford Global Technologies, Inc., Dearborn, Mich.

[21] Appl. No.: 780,033

[22] Filed: Dec. 23, 1996

[51] Int. Cl.[6] ..... F02D 41/00; F02M 23/00; F02M 25/00

[52] U.S. Cl. ..... 123/694

[58] Field of Search ..... 123/694, 693; 60/284, 285, 274

[56] References Cited

U.S. PATENT DOCUMENTS 5,211,011 5/1993 Nishikawa et al. ..... 60/284
5,230,322 7/1993 Curran et al. ..... 123/694
5,253,632 10/1993 Brooks ..... 123/696
5,465,697 11/1995 Hamburg et al. ..... 123/424
5,558,076 9/1996 Maki et al. ..... 123/687

*Primary Examiner*—Raymond A. Nelli
*Attorney, Agent, or Firm*—Allan J. Lippa

[57] ABSTRACT

An engine air/fuel ratio control system maintains average engine air/fuel ratio at a desired lean air/fuel ratio during cold engine operation in order to more rapidly warm the catalytic converter. Fuel delivered to the engine is modulated with a truncated triangular wave which is truncated to minimize lean air/fuel excursions. An error signal is generated from the exhaust gas oxygen sensor output, and a proportional plus integral control responsive to the error signal generates a feedback correction value to maintain the desired air/fuel ratio. Gain of the controller is increased when the error signal indicates engine air/fuel operation leaner than a preselected air/fuel ratio to further minimize excursions in a fuel enleanment direction.

13 Claims, 6 Drawing Sheets

LEAN AIR/FUEL ENGINE FEEDBACK CONTROL SYSTEM

BACKGROUND OF THE INVENTION

The field of the invention relates to engine air/fuel control systems and in particular control systems which maintain a desired lean air/fuel ratio.

A lean air/fuel engine control system is disclosed in U.S. Pat. No. 5,211,011. Fuel delivered to the engine is alternated between rich and lean values while ignition timing is retarded to more rapidly heat the catalytic converter.

The inventors herein have recognized numerous problems with the above and similar approaches. For example, the fuel modulation utilized may result in excessively lean air/fuel excursions and resulting engine roughness or misfire.

SUMMARY OF THE INVENTION

An object of the invention claimed herein is to provide lean air/fuel engine operation with feedback control without incurring excessively lean air/fuel engine operation.

The problems of prior approaches are overcome, and the objects and advantages of the claimed invention achieved, by providing both a control method and a control system for controlling fuel delivered to an internal combustion engine in response to an exhaust gas oxygen sensor output. In one particular aspect of the invention, the method comprises the steps of: generating a fuel modulation signal for modulating the delivered fuel; adjusting the delivered fuel with a feedback variable to maintain a desired air/fuel ratio; generating an air/fuel ratio indicating signal from the exhaust gas oxygen sensor output; generating an error signal from a difference between the air/fuel ratio indicating signal and a reference signal related to the desired air/fuel ratio; generating the feedback signal from a controller responsive to the error signal, the controller having a selectable gain; and increasing the gain when the error signal is leaner than a preselected air/fuel ratio.

An advantage of the above aspect of the invention is that engine air/fuel operation is provided at a desired average lean value without excessively lean excursions. Another advantage is that the gain of the control system is increased when leaner than desired air/fuel operation occurs, thereby providing rapid corrections and avoiding excessively lean excursions.

In another aspect of the invention, the method comprises the steps: generating a fuel modulation signal for modulating the delivered fuel, the modulation signal having a first state and a second state for respectively causing fuel enleanment and fuel enrichment of the delivered fuel, the second state being greater than the first state; adjusting the delivered fuel with a feedback variable to maintain a desired air/fuel ratio lean of stoichiometry; averaging the exhaust gas oxygen sensor output to generate an air/fuel ratio indicating signal; generating an error signal from a difference between the air/fuel ratio indicating signal and a reference signal related to the desired air/fuel ratio; generating the feedback signal by at least integrating the error signal, the integration having a first gain value in a fuel enleanment direction and a second gain value in a fuel enrichment direction; and increasing the second gain value when the error signal is leaner than a preselected air/fuel ratio.

An advantage of the above aspect of the invention is that the gain of the control system is decreased in a fuel enleanment direction (i.e. when lean fuel corrections are being made) to reduce any over shooting of the preselected lean air/fuel ratio.

BRIEF DESCRIPTION OF THE DRAWINGS

The object and advantages of the claimed invention will become more readily apparent from the following detailed example of operation described with reference to the drawings wherein:

DESCRIPTION OF AN EXAMPLE OF OPERATION

Figure 1:
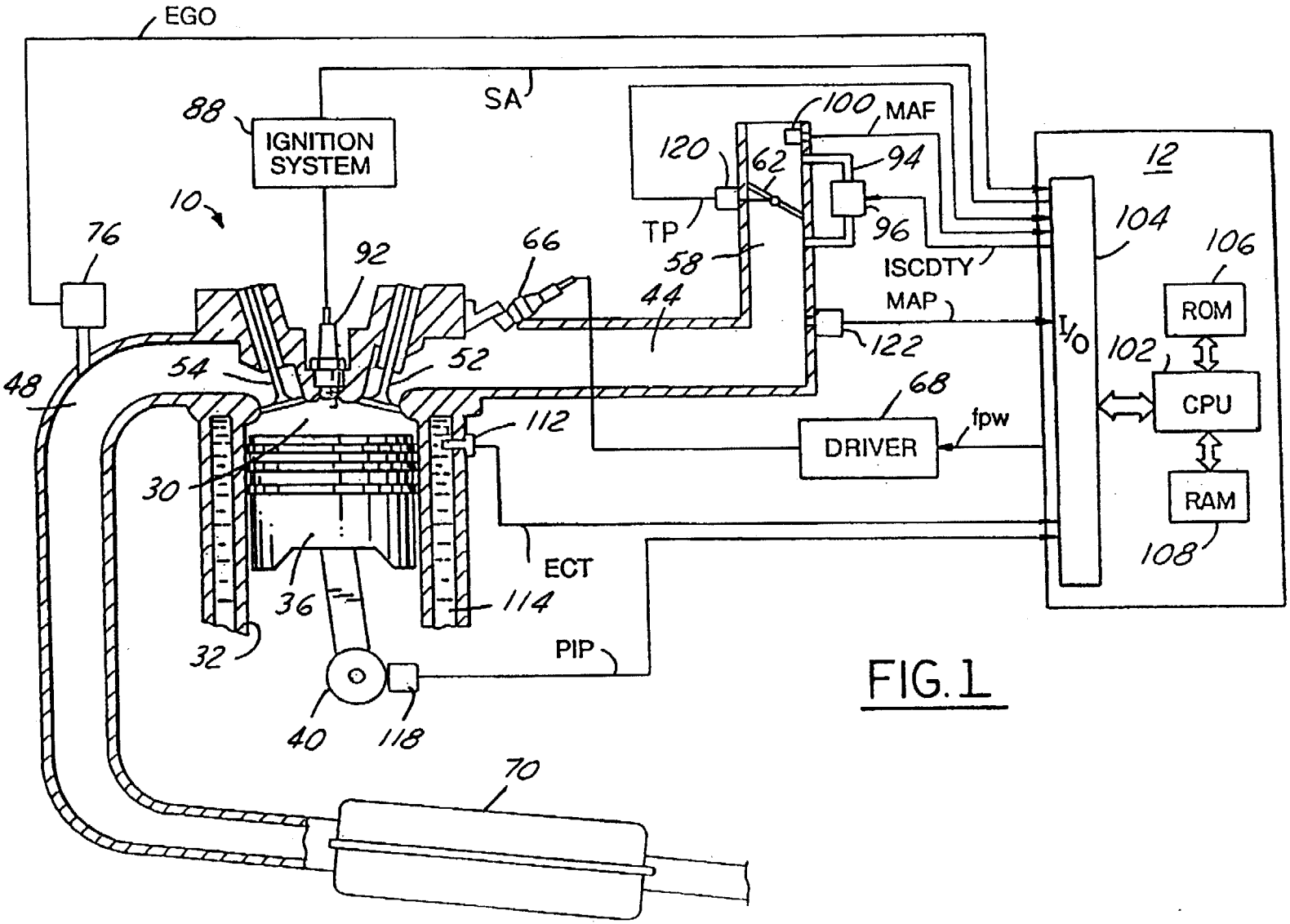
FIG. 1 is a block diagram of an embodiment in which the invention is used to advantage.

Internal combustion engine 10 comprising a plurality of cylinders, one cylinder of which is shown in FIG. 1, is controlled by electronic engine controller 12. Engine 10 includes combustion chamber 30 and cylinder walls 32 with piston 36 positioned therein and connected to crankshaft 40. Combustion chamber 30 is shown communicating with intake manifold 44 and exhaust manifold 48 via respective intake valve 52 and exhaust valve 54. Intake manifold 44 is shown communicating with throttle body 58 via throttle plate 62. Intake manifold 44 is also shown having fuel injector 66 coupled thereto for delivering liquid fuel in proportion to the pulse width of signal fpw received from controller 12 via conventional electronic driver 68. Fuel is delivered to fuel injector 66 by a conventional fuel system (not shown) including a fuel tank, fuel pump, and fuel rail. Although a "port injection" system is shown herein with one injector for injecting fuel to the intake port of each cylinder, other types of fuel delivery systems may also be used, such as central fuel injection having a single fuel injector for multiple cylinders.

Exhaust gas oxygen sensor 76 is shown coupled to exhaust manifold 48 upstream of catalytic converter 70. In this particular example, sensor 76 provides signal EGO to controller 12 which converts signal EGO into two-state signal EGOS. A high voltage state of signal EGOS indicates exhaust gases are rich of a desired air/fuel ratio and a low voltage state of signal EGOS indicates exhaust gases are lean of the desired air/fuel ratio. Typically, the desired air/fuel ratio is selected at stoichiometry which falls within the peak efficiency window of catalytic converter 70.

Idle bypass passageway 94 is shown coupled to throttle body 58 in parallel with throttle plate 62 to provide air to intake manifold 44 via solenoid valve 96 independently of the position of throttle plate 62. Controller 12 provides pulse width modulated signal ISCDTY to solenoid valve 96 so that airflow is inducted into intake manifold 44 at a rate proportional to the duty cycle of signal ISCDTY for controlling engine idle speed.

Conventional distributorless ignition system 88 provides ignition spark to combustion chamber 30 via spark plug 92 in response to spark advance signal SA from controller 12.

Controller 12 is shown in FIG. 1 as a conventional microcomputer including: microprocessor unit 102, input/ output ports 104, an electronic storage medium for executable programs and calibration values shown as read only memory chip 106 in this particular example, random access memory 108, and a conventional data bus. Controller 12 is shown receiving various signals from sensors coupled to engine 10, in addition to those signals previously discussed, including: measurements of inducted mass air flow (MAF) from mass air flow sensor 100 which is coupled to throttle body 58 upstream of air bypass passageway 94 to provide a total measurement of airflow inducted into intake manifold 44 via both throttle body 58 and air bypass passageway 94; engine coolant temperature (ECT) from temperature sensor 112 coupled to cooling sleeve 114; a profile ignition pickup signal (PIP) from Hall effect sensor 118 coupled to crankshaft 40; and throttle position TP from throttle position sensor 120; and absolute Manifold Pressure Signal MAP from sensor 122. Engine speed signal RPM is generated by controller 12 from signal PIP in a conventional manner and manifold pressure signal MAP provides an indication of engine load.

Figure 2A:
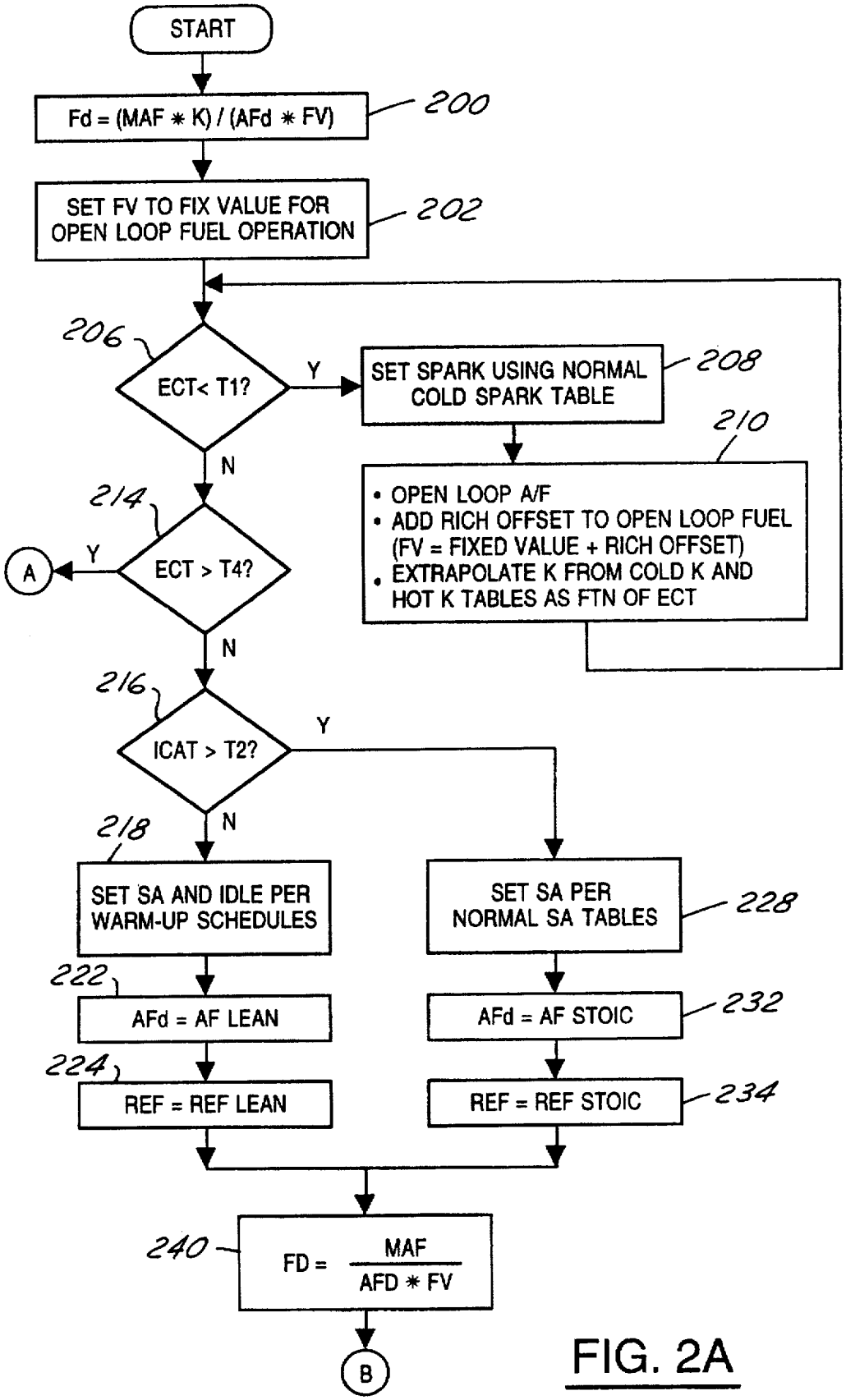
FIGS. 2A–2B are flow charts of various operations performed by portions of the embodiment shown in FIG. 1.
Figure 2B:
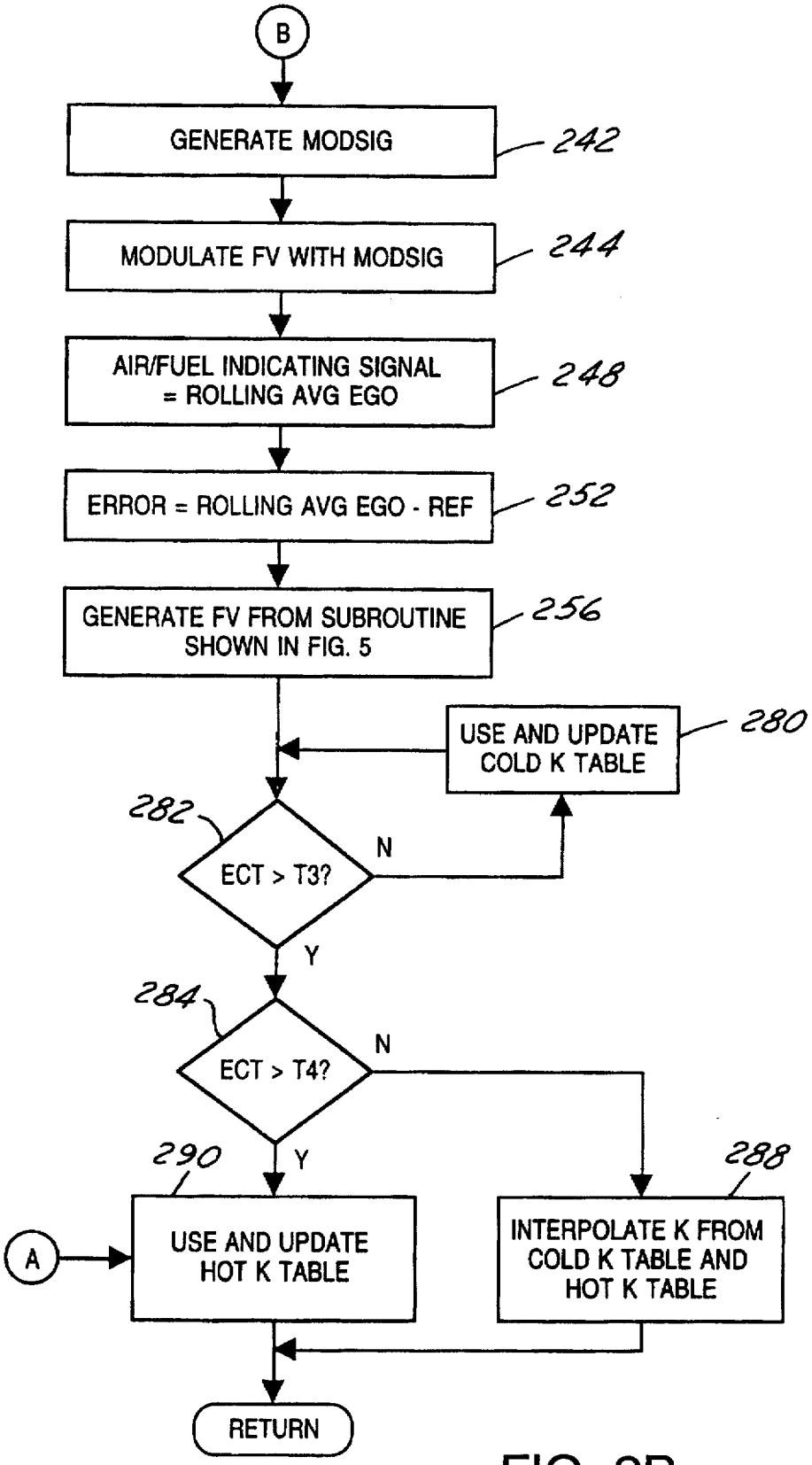

A description of various air/fuel operations performed by controller 12 is now provided with initial reference to the flow charts shown in FIGS. 2A–2B. During step 200, the fuel command (shown as desired fuel quantity Fd) is calculated by dividing the product of desired air/fuel ratio AFd times feedback variable FV into the product of inducted mass flow measurement MAF times correction value K. In this particular example, desired air/fuel ratio AFd is the stoichiometric value of the fuel blend used which is 14.3 pounds of air per pound of fuel for a low emissions fuel blend. Feedback variable FV is generated by the feedback routine, responsive to EGO sensor 76, which is described later herein with particular reference to respective FIGS. 2B and 5.

Continuing with FIG. 2A, feedback variable FV is initially set to a fixed value for open loop air/fuel operation (step 202). Stated another way, desired fuel quantity Fd provides an open loop fuel command which is related to signal MAF and is not adjusted by feedback. In this particular example, feedback variable FV is set to unity which would correspond to operation at desired air/fuel ratio AFd under ideal operating conditions without any engine component aging. It is well known, however, that this open loop operation may not result in engine air/fuel exactly at stoichiometry. Correction by correction value K, however, will be provided as described below.

When engine coolant temperature ECT is less than predetermined temperature T1 (step 206), engine temperature is too low to enter the subroutine for converter warm-up. The subroutine described with reference to steps 208–210 is then entered to minimize the time required to start and reliably warm-up engine 10. In step 208, ignition timing is first set using the cold start table stored in ROM 106. Various sub steps are then performed during step 210. Open loop air/fuel operation proceeds by adding a rich offset to desired fuel quantity Fd. In this particular example, feedback variable FV is set to a fixed value less than unity. Correction value K is then extrapolated from two tables stored in ROM 106 which store correction K for cold engine operation and hot engine operation, respectively. In this example, the extrapolation occurs as a function of engine coolant temperature ECT.

In the event engine coolant temperature ECT is greater than temperature T1 (step 206), it is compared to temperature T4 (step 214) which is associated with hot engine operation and normal air/fuel ratio control. If engine coolant temperature ECT is less than temperature T4, an inference of the temperature of catalytic converter 70 (ICAT) is compared to temperature T2 (step 216).

When inferred temperature ICAT is less than temperature T2, ignition timing and engine idle speed are set per the warm-up schedules (step 218) provided for rapid catalyst warm-up. That is, ignition timing is retarded from its nominal value and idle speed elevated. Desired engine air/fuel ratio AFd is set to a lean value (AFLEAN) which is lean of stoichiometry by a preselected amount as shown in step 222. In this particular example, stoichiometry is 14.3 pounds of air per pound of fuel and AFLEAN is 14.6 pounds of air per pound of fuel. During step 224, reference signal REF is set equal to lean value REFLEAN which corresponds to desired lean air/fuel ratio AFLEAN.

On the other hand, if inferred temperature ICAT is greater than temperature T2, normal ignition timing and idle speed tables are utilized (step 228). Desired air/fuel ratio AFd is then set equal to the air/fuel ratio corresponding to stoichiometry (AFSTOIC) as shown in step 232. During step 234, reference signal REF is set equal to a value corresponding to the stoichiometric air/fuel ratio (REFSTOIC).

Figure 3:
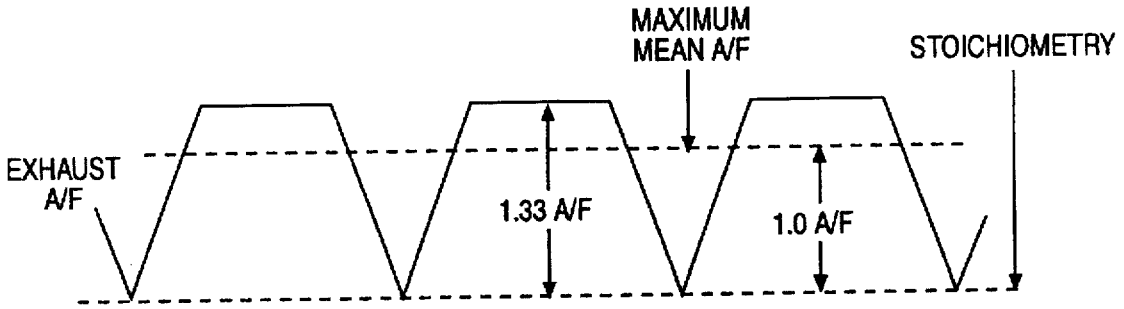
FIG. 3 illustrates the fuel modulation signal which is described in more detail with particular reference to FIGS. 2A–2B.

Desired fuel quantity Fd is generated during step 240 which corresponds to the amount of liquid fuel to be delivered to engine 10. More specifically, desired fuel quantity signal Fd is generated by dividing the product of desired air/fuel ratio AFd and feedback variable FV into measurement of inducted mass air flow MAF times a correction value (not shown). Feedback variable FV is modulated during step 244 by modulation signal MODSIG which is generated in this particular example as the truncated triangular wave form shown in FIG. 3. The triangular wave form is truncated in a direction to cause fuel enleanment without causing excessively lean air/fuel operation.

A rolling average of signal EGO is generated during step 248. Error signal ERROR is generated during step 252 by subtracting reference signal REF from the rolling average of signal EGO (252). The feedback variable FV is then generated by applying a proportional plus integral (PI) controller to signal ERROR described later herein with particular references to FIG. 5.

Figure 4:
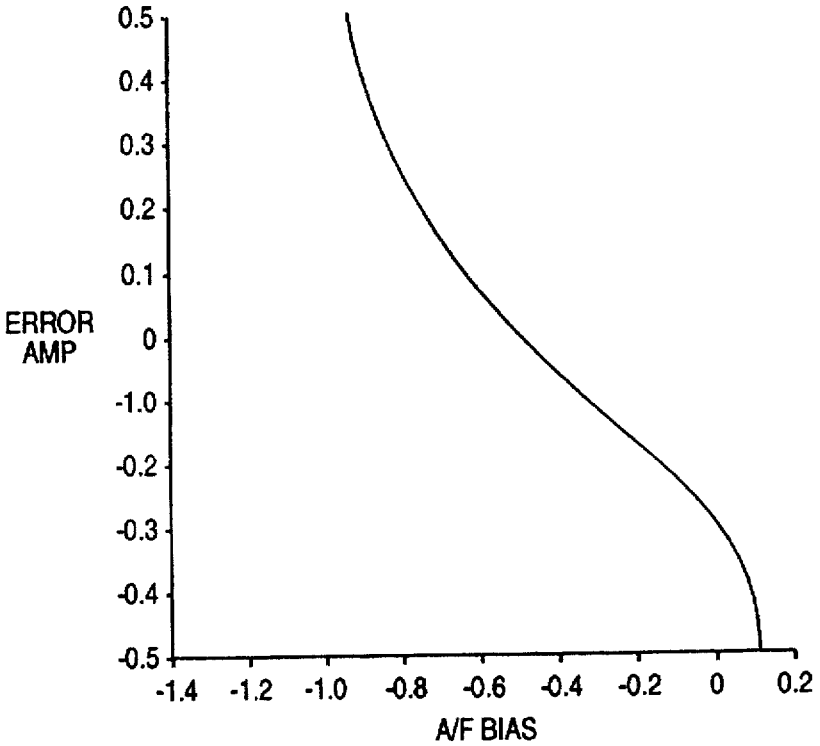
FIG. 4 is a graphical representation showing how the rolling average of signal EGO provides an average air/fuel indicating signal.

Referring to FIG. 4, a hypothetical graphical representation of the rolling average of signal EGO, which is the lean air/fuel indicating signal in relation to the average engine air/fuel ratio, is shown. It is seen that an advantage of the invention claimed herein is that a somewhat linear air/fuel indicating signal is provided from a two-state exhaust gas oxygen sensor. In this particular example, the air/fuel indicating signal is used to operate engine 10 at an average value lean of stoichiometry using accurate feedback control.

Figure 5:
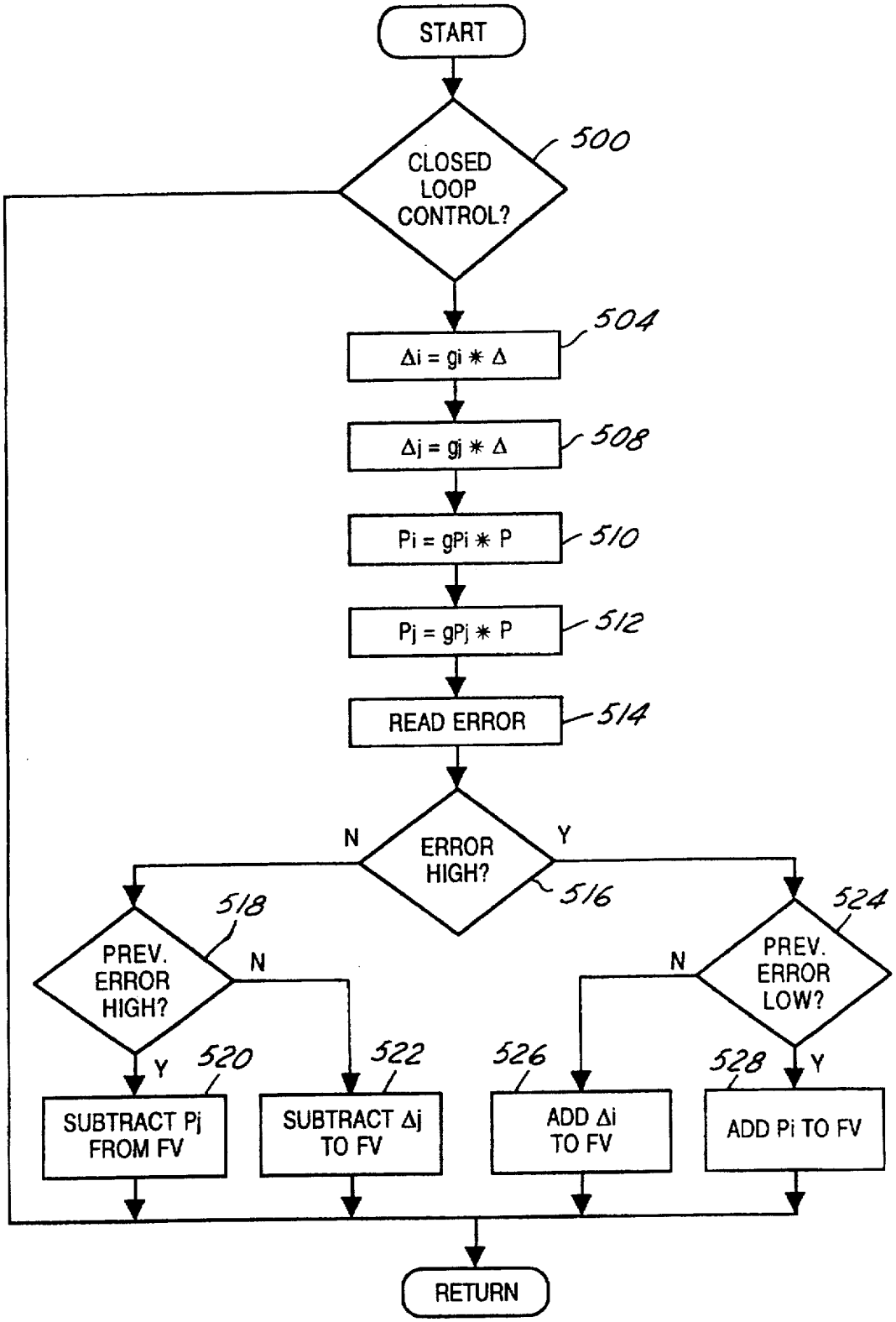
FIG. 5 illustrates a proportional plus integral controller which generates feedback variable FV.

Controller 12 executes an air/fuel feedback routine to generate feedback variable FV as now described with reference to the flowchart shown in FIG. 5. In general, feedback variable FV is generated each background loop of controller 12 by a proportional plus integral (PI) controller responsive signal ERROR generated by the routine shown in FIG. 2B. The integration steps for integrating signal EGOS in a direction to cause a lean air/fuel correction are provided by integration steps Δi, and the proportional term for such correction provided by Pi. Similarly, integral term Δj and proportional term Pj cause rich air/fuel correction. As shown in steps 504–512, step Δi is equal to gain value gi times integration step Δ; step Δj is equal to the product of gain gj and step Δ; Pi is equal to the product of gain gpi and value P; and Pj is equal to the product of gain gpj and value P.

Initial conditions which are necessary before feedback control is commenced, such as temperature ECT being above a preselected value, are first checked in step 500. When signal ERROR is low (step 516), but was high during the previous background loop of controller 12 (step 518), preselected proportional term Pj is subtracted from feedback variable FV (step 520). When signal ERROR is low (step 516), and was also low during the previous background loop (step 518), preselected integral term Δj, is subtracted from feedback variable FV (step 522).

Similarly, when signal ERROR is high (step 516), and was also high during the previous background loop of controller 12 (step 524), integral term Δi is added to feedback variable FV (step 526). When signal ERROR is high (step 516), but was low during the previous background loop (step 524), proportional term Pi is added to feedback variable FV (step 528).

Figure 6:
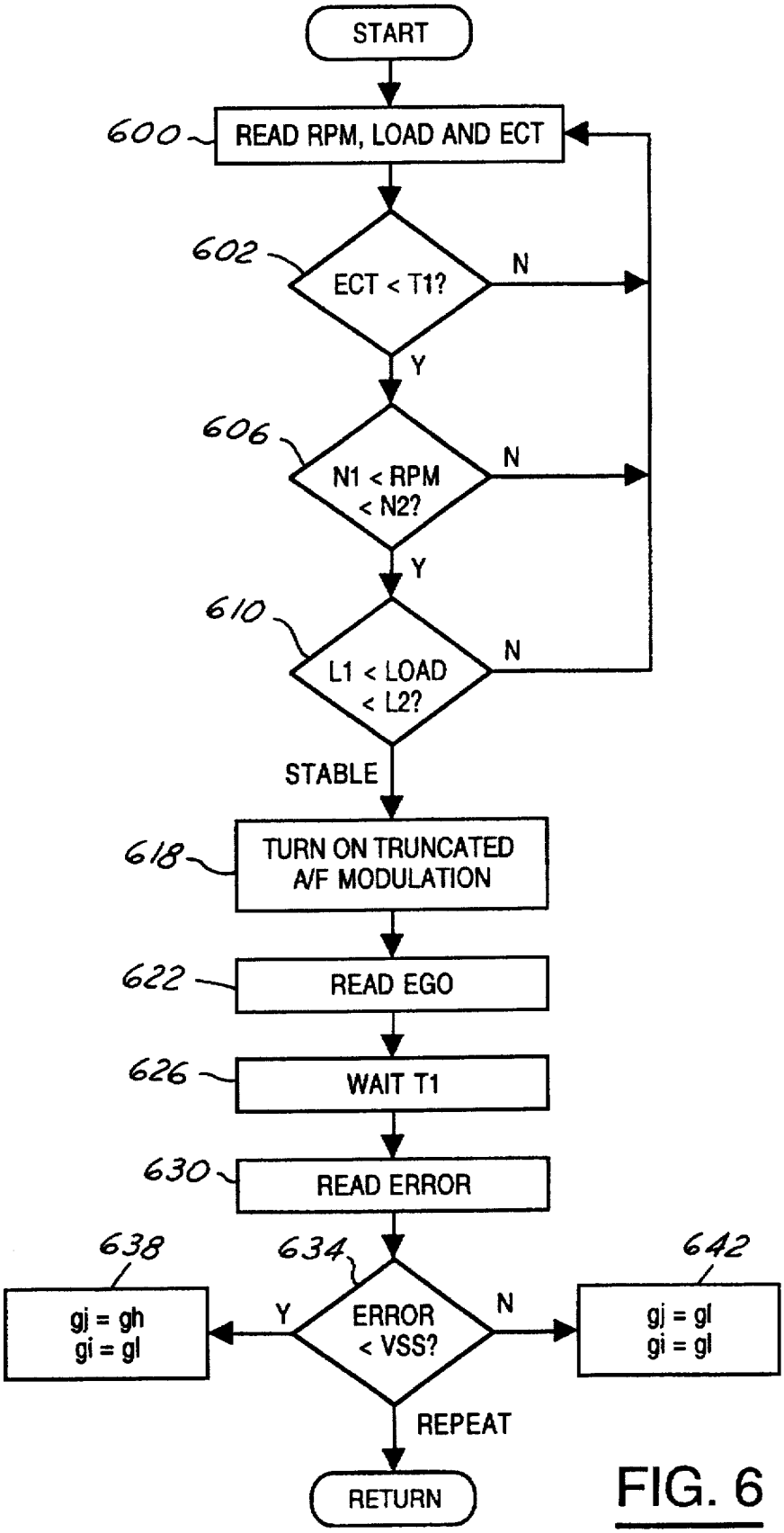
FIG. 6 is a flow chart of various operations performed by portions of the embodiment shown in FIG. 1.

The gain of the air/fuel control system is generated as now described with particular reference to FIG. 6. Engine speed, load, and engine coolant temperature ECT are read during step 600. When these parameters are within desired ranges (step 602–610), the truncated triangular wave form is actuated during step 618 to modulate fuel delivered to engine 10. In this particular example, a truncated triangular wave is selected to limit excursions in the lean air/fuel direction. The amplitude and base of the triangular wave may also be selected to achieve a desired lean air/fuel ratio while minimizing lean air/fuel excursions.

Signal EGO is read during 622 and the rolling average of signal EGO calculated as previously described with reference to FIGS. 2A–2B. The rolling average is then compared to the air/fuel ratio and signal ERROR generated. After a delay of T1 seconds (steps 626), signal ERROR is read during step 630.

When signal ERROR is less than preselected amplitude VSS, indicating that air/fuel operation is leaner than a preselected lean air/fuel ratio, the gain of the control system in the rich air/fuel correction direction is increased (step 638). Stated another way, gain gj is set equal to high gain value gh during step 638 to increase the responsiveness of the PI controller.

On the other hand, when signal ERROR is greater than value VSS, indicating engine air/fuel operation is not leaner than the preselected value associated with value VSS, the gain of the air/fuel control system is reduced (step 642). Stated another way, gain value gj, associated with gain in a direction to cause rich air/fuel corrections, is set equal to lower gain value gl.

It is noted that during all phases of operations, the gain gi, corresponding to lean air/fuel corrections, is set equal to low gain value gl to reduce over shooting of the preselected lean air/fuel ratio.

This concludes a description of an example in which the invention is used to advantage. Those skilled in the art will recognize that many alterations and modifications may be made to this example without departing from the spirit and scope of the invention claimed therein. For example, modulating signals other than a triangular wave form may be used to advantage, and triangular wave forms other than shown herein may be used to advantage.

What is claimed:

1. A method for controlling fuel delivered to an internal combustion engine in response to an exhaust gas oxygen sensor output, comprising the steps of;

adjusting the delivered fuel with a feedback variable to maintain a desired air/fuel ratio;

generating an error signal related to a difference between actual and desired air/fuel ratio;

generating said feedback signal from a controller responsive to said error signal, said controller having a selectable gain; and increasing said gain when said error signal is leaner than a preselected air/fuel ratio.

2. A method for controlling fuel delivered to an internal combustion engine in response to an exhaust gas oxygen sensor output, comprising the steps of;

generating a fuel modulation signal for modulating the delivered fuel;

adjusting the delivered fuel with a feedback variable to maintain a desired air/fuel ratio;

generating an air/fuel ratio indicating signal from the exhaust gas oxygen sensor output;

generating an error signal from a difference between said air/fuel ratio indicating signal and a reference signal related to said desired air/fuel ratio;

generating said feedback signal from a controller responsive to said error signal, said controller having a selectable gain; and increasing said gain when said error signal is leaner than a preselected air/fuel ratio.

3. The method recited in claim 2 wherein said step of generating said modulation signal generates said modulation signal having a first state and a second state for respectively causing fuel enleanment and fuel enrichment of the delivered fuel, said second state being greater than said first state.

4. The method recited in claim 3 wherein said step of generating said modulation signal further comprises a step of generating a triangular wave with a truncated peak value in the direction causing fuel enleanment.

5. The method recited in claim 2 wherein said step of generating said air/fuel ratio indicating signal further comprises a step of averaging the exhaust gas oxygen sensor output.

6. The method recited in claim 2 wherein said step of increasing said gain further comprises a step of comparing said error signal to a preselected value.

7. The method recited in claim 2 wherein said desired air/fuel ratio is lean of stoichiometry.

8. A method for controlling fuel delivered to an internal combustion engine in response to an exhaust gas oxygen sensor output, comprising the steps of;

generating a fuel modulation signal for modulating the delivered fuel; said modulation signal having a first state and a second state for respectively causing fuel enleanment and fuel enrichment of the delivered fuel, said second state having a greater amplitude than said first state;

adjusting the delivered fuel with a feedback variable to maintain a desired air/fuel ratio lean of stoichiometry;

averaging the exhaust gas oxygen sensor output to generate an air/fuel ratio indicating signal;

generating an error signal from a difference between said air/fuel ratio indicating signal and a reference signal related to said desired air/fuel ratio;

generating said feedback signal by at least integrating said error signal, said integration having a first gain value in a fuel enleanment direction and a second gain value in a fuel enrichment direction; and increasing said second gain value when said error signal is leaner than a preselected air/fuel ratio.

9. The method recited in claim 8 wherein said desired air/fuel ratio is lean of stoichiometry when temperature of the engine is less than a preselected value and said desired air/fuel ratio is at stoichiometry when said engine temperature is greater than said preselected value.

10. The method recited in claim 8 wherein said step of generating said modulation signal further comprises a step of generating a triangular wave with a truncated peak value in the direction causing fuel enleanment.

11. The method recited in claim 8 wherein said first gain value is less than said second gain value.

12. An electronic memory containing a computer program to be executed by an engine controller which controls fuel delivered to the engine in response to an exhaust gas oxygen sensor output, comprising;

fuel modulation code means for generating a fuel modulation signal to modulate the delivered fuel, said modulation signal having a first state and a second state for respectively causing fuel enleanment and fuel enrichment of the delivered fuel, said second state being greater than said first state;

fuel adjusting code means for adjusting the delivered fuel with a feedback variable to maintain a desired air/fuel ratio lean of stoichiometry;

averaging code means for averaging the exhaust gas oxygen sensor output to generate an air/fuel ratio indicating signal;

error signal code means for generating an error signal from a difference between said air/fuel ratio indicating signal and a reference signal related to said desired air/fuel ratio;

feedback variable code means for generating said feedback signal by at least integrating said error signal, said integration having a gain value in a fuel enleanment direction; and gain control code means for increasing said gain value when said error signal is leaner than a preselected air/fuel ratio.

13. The memory recited in claim 12 wherein said gain control means decreases said gain value when said error signal is richer than said preselected air/fuel ratio.

* * * * *